US005803839A

United States Patent [19]

Palmer et al.

[11] Patent Number: 5,803,839

[45] Date of Patent: Sep. 8, 1998

[54] BACKYARD BASEBALL GAME

[76] Inventors: Robert Palmer, 16 Burnwood Dr., Bloomfield, Conn. 06002; Kenneth Vayda, 21 Horseshoe Cir., Simsbury, Conn. 06070

[21] Appl. No.: 645,238

[22] Filed: May 13, 1996

[51] Int. Cl.[6] ..... A63B 63/00

[52] U.S. Cl. ..... 473/439; 473/104; 473/462; 273/400; 273/402; 273/410

[58] Field of Search ..... 273/411, 410, 273/398, 400, 402; 473/422, 462, 104

[56] References Cited

U.S. PATENT DOCUMENTS

| | | | |
|---|---|---|---|
| 4,037,095 | 7/1977 | Nedwick | 273/400 |
| 4,492,380 | 1/1985 | Saytar | 273/400 |
| 4,982,966 | 1/1991 | Teafatiller | 273/400 |
| 5,524,901 | 6/1996 | Bison | 473/462 |
| 5,527,032 | 6/1996 | Coleman | 273/410 |

*Primary Examiner*—Theatrice Brown
*Attorney, Agent, or Firm*—Patrick J. Walsh

[57] ABSTRACT

An informal baseball game played with a few players on each side, equipment for defining a strike zone and hit zones, and with a set of rules.

2 Claims, 3 Drawing Sheets

BACKYARD BASEBALL GAME

BACKGROUND OF THE INVENTION

The present invention relates to a variation of the game of baseball played on a small field with fewer than the regulation complement of players.

Baseball is an enormously popular game in which the preferred manner of play is to organize a large number of players into several teams forming an amateur or professional league for competing with each other and with other leagues on regulation fields for an extended season all according to well-known rules of play.

Baseball is also played with lesser formality in practice sessions involving fewer players on such fields as may be available with little or no regard for rules of play.

This invention provides for a backyard baseball game with a play format and play equipment intended to generate interest and competition in a game played informally as compared to organized baseball league standards.

SUMMARY OF THE INVENTION

The present invention comprises an informal baseball game played with a few players on each side, with a smaller field, and with a set of rules that create interest, proficiency, and competition on the part of the players.

The game is organized as a set of equipment for laying out a play field and a set of rules for playing the game.

In preferred form, the set of equipment includes a carrying case for the equipment, with the carrying case serving as a backstop having means for determining balls and strikes, as a case for equipment including bats, balls, marker flags for laying out a playing field, a pitching rubber, home plate, and as a scoreboard for keeping score and for displaying the rules of the game for all to see.

The rules of play, in general, follow the usual baseball format and are customized for use with the equipment provided and for accommodating the limited number of players competing on each team.

OBJECTS OF THE INVENTION

It is an object of the invention to provide a set of equiment and format for playing backyard baseball.

It is an object of the invention to provide a game of backyard baseball with a set of rules defining a playing format that promotes interest, proficiency and competition in players, particularly players learning the game of baseball.

It is a further object of the invention to provide a backyard baseball game with informal rules particularly suited for play with a limited number of players on each team.

Other and further objects of the invention will occur to one skilled in the art with an understanding of the following detailed description of the invention or upon employment of the invention in practice.

DESCRIPTION OF THE DRAWING

A preferred embodiment of the invention has been chosen for purposes of illustrating the construction and operation of the invention and is shown in the accompanying drawing in which.

DETAILED DESCRIPTION OF THE INVENTION

Figure 5:
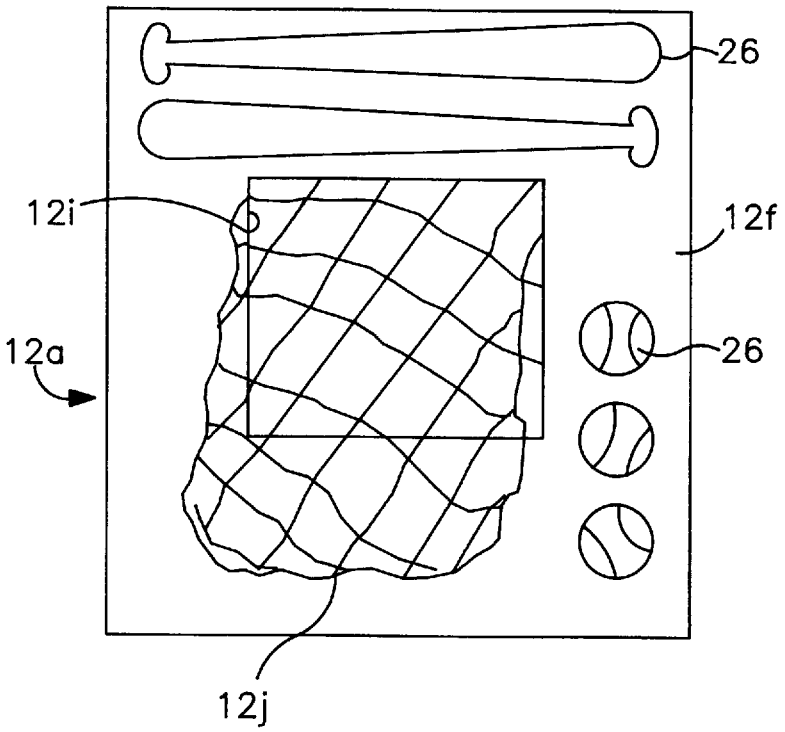
FIG. 5 is an elevational view of the inner face of said one panel of the carrying case with equipment, namely bats and balls, stored on the inner face.
Figure 6:
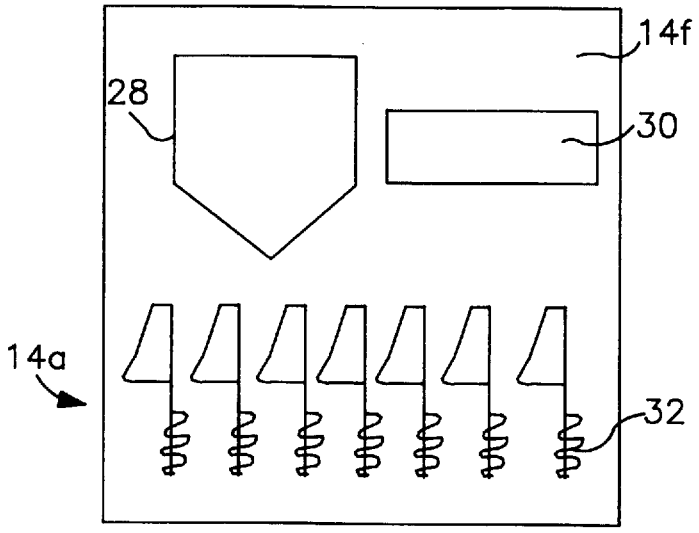
FIG. 6 is an elevational view of the inner face of said other panel of the carrying case with equipment, namely home plate, pitching rubber, and marker flags, stored on the inner face.

Referring now to the drawing, the invention comprises an equipment set organized in a carrying case 10 formed by a pair of similar, generally rectangular receptacles 12, 14, that are joined along a common margin 16 by means of a hinge 18. Each receptacle has a panel 12*a*, 14*a*, and upstanding wall members 12 *b–e*, and 14 *b–e*, along the periphery of each panel for defining interior chambers 12*k*, 14*k* for storage of game equipment on the inner face 12*f*, 14*f* of each panel as shown in FIGS. 5 and 6. A handle 20 and latch 22 provide for carrying and securely closing the case.

Figure 2:
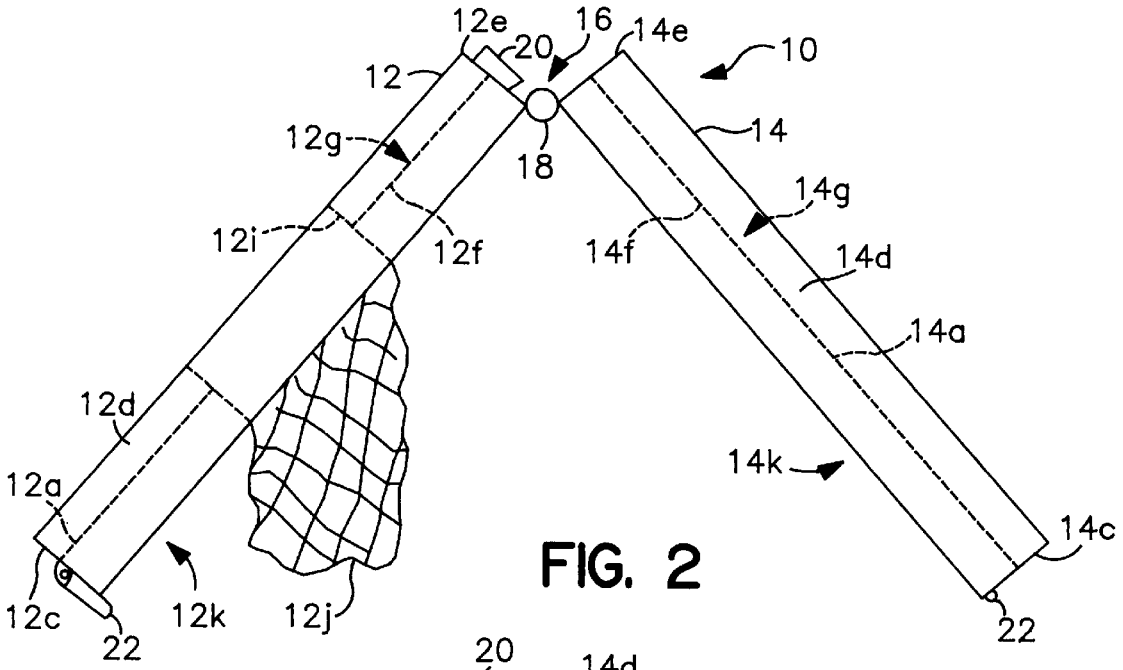
FIG. 2 is a plan view of the carrying case deployed for use in a game.
Figure 1:
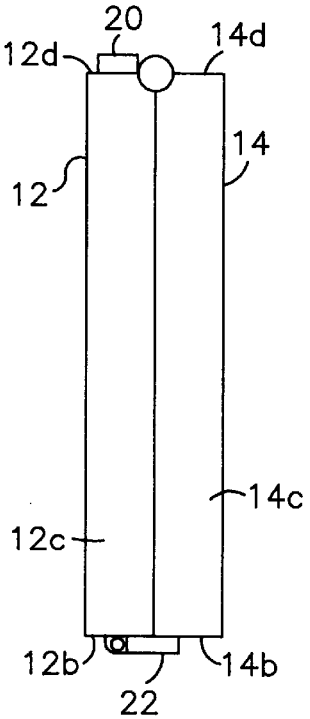
FIG. 1 is an end elevational view of a carrying case for equipment according to the invention.
Figure 4:
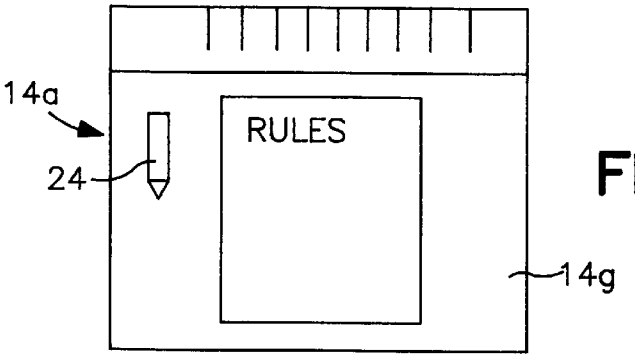
FIG. 4 is an elevational view of the outer face of another panel of the carrying case which face serves as a scoreboard and for displaying the rules of play.
Figure 3:
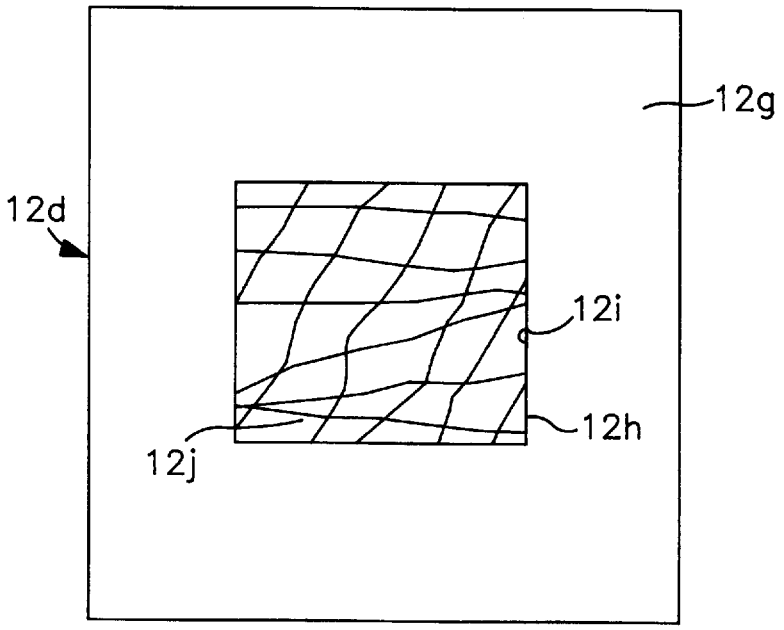
FIG. 3 is an elevational view of the outer face of one panel of the carrying case which face serves as a strike zone backboard.

The carrying case is deployed for a game in the position shown in FIG. 2 with case receptacles positioned at approximately a right angle to each other and with each panel generally vertical. In this position of the case, the outer face 12*g* (FIG. 3) of the one panel 12*a* defines a backboard or backstop functioning as a target for the pitcher, and the outer face 14*g* (FIG. 4) of the other panel serves as a scoreboard, and if desired, the rules of play can be displayed here.

The backstop panel 12*g* has a strike zone defined by a plastic border 12*h* surrounding a square opening 12*i* in the center of the backstop. The plastic border is in the strike zone. Netting 12*j* backs the opening 12*i* to catch any pitched ball passing directly through the opening.

The scoreboard panel is provided with an innings grid 14*h* for recording the score for each half inning with a marker 24 provided as part of the game.

The inner faces 12*f*, 14*f* of each panel have storage capability, respectively, for bats 26, balls 26, and for home plate 28, a pitching slab 30, and marker flags 32.

The preferred rules of play are:

I. General Rules of the Game a. Innings. A normal game consists of nine innings with each team having a "side" at bat and in the field.

b. Outs. The number of players per team determines the number of outs per side. Two players per team have two outs, three players have three outs, four players have four outs, and so forth.

c. Players. Two to three players per team, at a minimum.

d. Runs. Players take turns at bat, however, they do not run the bases. Each team scores runs by the imaginary runner being "forced in" to home plate by a base hit or a walk.

e. Forced Bases. A runner must be forced to the next imaginary base by a hit or walk. (i.e., a runner on third base does not advance home by a single or double, when first and second based are not occupied.)

II. Hitting a. Single. Any fair hit ball which rolls beyond the back of the pitcher's mound and either stops rolling before it is fielded or is bobbled by an outfielder. A single produces an imaginary runner on an imaginary first base.

b. Double. Any fair hit ball which travels beyond the pitcher's mound on the fly and is not caught by an outfielder.

c. Triple. Any fair hit ball which travels beyond the "triple" markers on the fly and is not caught by an outfielder d. Home Run. Any fair hit ball which travels over the perimeter fence for the field or over the home run marker and is not caught by an outfielder.

e. Strike. There are three strikes to an out. The following represent a strike:

1. A swing and miss at a pitched ball.
2. A foul ball.
3. A foul tip (except on a third strike)
4. A ground ball which does not reach the pitcher's mound.

f. Out. An out is made as follows:

1. Any fly ball which is caught by an outfielder.
2. Any ground ball which rolls beyond the pitcher's mound and is fielded cleanly by an outfielder.
3. Three strikes.
4. Any pitch, not swung on by the batter, that passes through the opening in the backstop on the fly is an automatic out retiring the batter, regardless of the number of strikes on the batter.

g. Foul ball. Any hit ball that does not land in fair territory.

III. Pitching a. Players must alternate pitching each inning. Each team designates its pitcher for the first inning.

b. Relief pitcher. After a run has been scored against the pitching team, a relief pitcher can be used to complete the inning. This does not effect the pitching rotation for the next inning, in that, a relief pitcher can close one inning and pitch the next following inning.

c. Strike.

1. Any pitch which, before hitting the ground, either hits the plastic zone of the back stop, or travels through the opening in the backstop.
2. Any pitch which hits the batter on the fly. (It is the batters responsibility to give way to a pitched ball.

d. Ball. Any pitch not ruled a strike.

e. Pitcher's mound. The pitcher may not cross over the pitcher's mound until; the pitch is fully released. Any "foot fault" is ruled a ball.

IV. Fielding a. Bobble. A bobble is defined as a hit ball which hits the ground first, is "bobbled" by the outfielder, and lands on the ground again. (If a fly ball is juggled by an outfielder but the ball does not hit the ground, the batter is out.)

b. Errors. Any ball dropped by an outfielder will be scored at the point where the player first touched the ball, and not where the ball lands after touching. (e.g., an outfield error beyond the triple markers is scored as a triple.)

c. Eligible outfielders. All fielders, including the pitcher are eligible outfielders.

To play, a field is selected, home plate and the pitching mound are established. The carrying case is opened as shown in FIG. 2 and deployed behind home plate with strike zone face 12*g* facing the pitching mound. Receptacle 14 extends away from home plate with the scoreboard and rules of play visible at face 14*g*. Marker flags are positioned to indicate the foul lines for defining fair territory and foul territory. Marker flags are also used to mark fair territory for triples and for home runs.

Hit zones, all in fair territory, are defined for singles as a ground ball not fielded that rolls beyond the pitchers mound; doubles are fly balls landing in the space between the pitchers mound and the triples flag, and triples are fly balls landing in the space beyond the triples flag up to the home runs flag or the perimeter fence, and, of course, home runs are fly balls over the home run flag or the perimeter fence.

The game can be played using a backboard 3 feet tall and 2.5 feet wide, a bat approximately 2 feet, 8 inches long, a ball 3 inches in diameter and which backboard, bat and balls fabricated of a durable plastic. Wiffle balls are suitable for play.

Various changes may be made to the structure embodying the principles of the invention. The foregoing embodiment is set forth in an illustrative and not in a limiting sense. The scope of the invention is defined by the the claims appended hereto.

We claim:

1. An equipment set for playing a backyard game of baseball comprising a carrying case defined by a pair of similar, generally rectangular panels joined along a common margin by means of a hinge, each receptacle having a panel, upstanding wall members along the periphery thereof for defining an interior chamber for receiving, and storing game equipment when said panels are pivoted to a face-to-face position; inner face for receiving and storing game equipment, one of said panels having an outer face defining a backstop functioning as a strike zone target, said strike zone being defined by a border surrounding an opening in the backstop panel, a net surrounding the opening to catch any pitched ball passing directly through the opening, and an outer face of the other of said panels having indicia defining an inning grid for recording the score for each half inning of the game.

2. The equipment as defined in claim 1, wherein;

a handle is attached to said panels along said common margin, and a latch is provided on an opposite margin of said panels.

* * * * *